US006497470B2

(12) United States Patent
Conta et al.

(10) Patent No.: US 6,497,470 B2
(45) Date of Patent: Dec. 24, 2002

(54) INK JET PRINTHEAD WITH LARGE SIZE SILICON WAFER AND RELATIVE MANUFACTURING PROCESS

(75) Inventors: Renato Conta, Ivrea (IT); Franco Fabbri, Ivrea (IT)

(73) Assignee: Olivetti Tecnost S.p.A., Ivrea (IT)

( * ) Notice: Subject to any disclaimer, the term of this patent is extended or adjusted under 35 U.S.C. 154(b) by 0 days.

(21) Appl. No.: 10/138,497

(22) Filed: May 6, 2002

(65) Prior Publication Data

US 2002/0126184 A1 Sep. 12, 2002

Related U.S. Application Data

(63) Continuation of application No. 09/340,507, filed on Jul. 1, 1999.

(30) Foreign Application Priority Data

Jul. 6, 1998 (IT) ..... TO98A0592

(51) Int. Cl.[7] ..... B41J 2/235
(52) U.S. Cl. ..... 347/20; 347/17; 29/890.1
(58) Field of Search ..... 347/17, 20, 54, 347/56, 62, 63, 60, 47; 29/890.1; 438/21; 156/359

(56) References Cited

U.S. PATENT DOCUMENTS 3,289,046 A 11/1966 Carr
4,296,421 A 10/1981 Hara et al.
4,663,640 A 5/1987 Ikeda
4,741,796 A 5/1988 Althaus et al.
H629 H 4/1989 Murdoch
4,899,180 A * 2/1990 Elhatem et al. ..... 347/17
5,278,584 A 1/1994 Keefe et al.
5,305,015 A 4/1994 Schantz et al.
5,367,324 A 11/1994 Abe et al.
5,442,384 A 8/1995 Schantz et al.
5,719,605 A 2/1998 Anderson et al.
6,190,492 B1 2/2001 Byrne et al.

OTHER PUBLICATIONS

European Search Report for European Application No. EP 99 11 2392, completed Sep. 28, 1999.

* cited by examiner

*Primary Examiner*—John Barlow
*Assistant Examiner*—Blaise Mouttet
(74) *Attorney, Agent, or Firm*—Banner & Witcoff, Ltd.

(57) ABSTRACT

An actuator assembly (81) for ink jet printheads, both monochromatic and colour, with a large number of nozzles (62), consists of a die (58) stuck on a rigid substrate (166) and divided into two parts lengthwise to permit the flow of ink from the tank to the nozzles (62), and a flat cable (130) with nozzles (62) stuck on the die (58); the actuator assembly (81) is produced by means of the operations of sticking the die (58) on the rigid substrate (166), making a through cut (173) along the entire length of the die (58), sticking the flat cable (130) with nozzles (62) on the die (58) and sealing the ends of the longitudinal cut (173) with glue. The object of the actuator assembly (81) and the relative manufacturing process is to prevent particularly long dice from breaking during manufacture of the head.

2 Claims, 15 Drawing Sheets

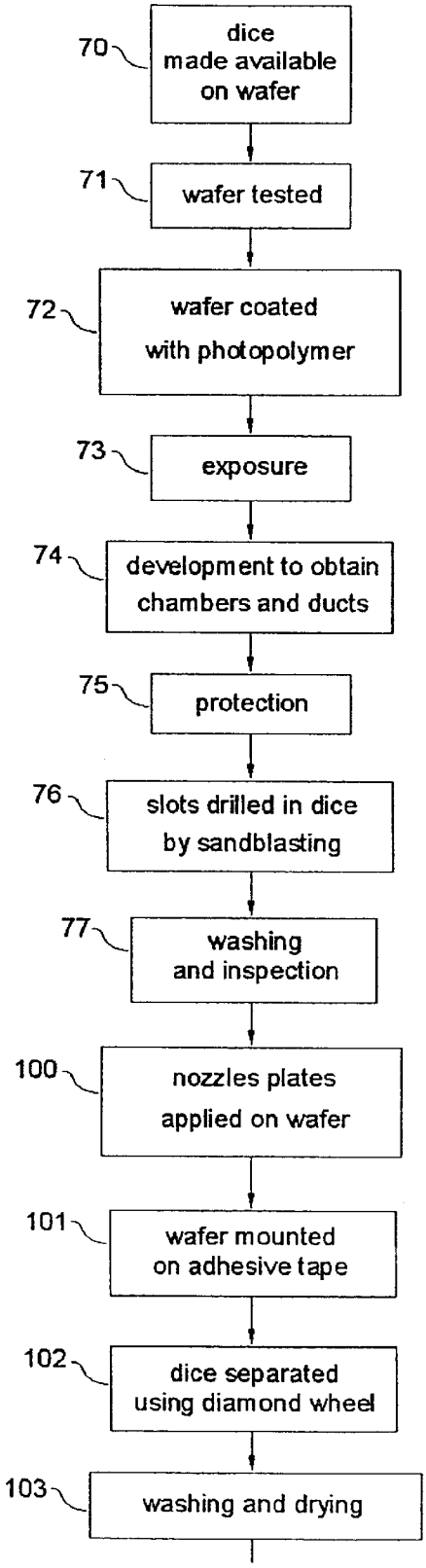
Fig. 3a
(PRIOR ART)
Fig. 3
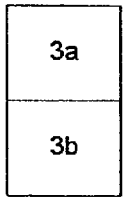
continues at step 105 of figure 3b

INK JET PRINTHEAD WITH LARGE SIZE SILICON WAFER AND RELATIVE MANUFACTURING PROCESS

This application is a continuation of prior application Ser. No. 09/340,507, filed Jul. 1, 1999. The entire disclosure of the prior application is hereby incorporated by reference herein.

TEXT OF THE DESCRIPTION

1. Background of the Invention

This invention relates to a printhead used in equipment for forming black and colour images, by way of successive scanning passes, on a print medium, normally though not exclusively a sheet of paper, using the thermal type ink jet technology, and more particularly to the actuator assembly of the head, and to the relative manufacturing process.

2. Prior Art

The composition and general mode of operation of a printhead according to the thermal type technology, and of the "top-shooter" type in particular, i.e. those that emit the ink droplets in a director perpendicular to the actuator assembly, are already widely known in the sector art, and will not therefore be discussed in detail herein, this description instead dwelling more fully on only some of the features of the heads and their manufacturing process, or relevance for the purposes of understanding this invention.

FIG. 1 shows an enlarged perspective view of an actuator assembly 80 of a monochromatic ink jet printhead, consisting of a die 51 of a semiconductor material (usually Silicon) on the upper face of which resistors 52 have been made for the emission of the ink droplets, driving circuits 53 for controlling the resistors 52, pads 54 for connecting the head to an electronic controller, not depicted in the figures, a resistive temperature sensor 65, reference marks 69, and which has a pass-through slot 55 along which the ink flows from a tank not shown in the figure. Attached to the upper face of the die is a layer 60 of photopolymer having a thickness less than or equal to 25 mm wherein are made, using known photolithographic techniques, a plurality of ducts 57 and a plurality of chambers 64 positioned in correspondence with the resistors 52.

Stuck above the photopolymer 60 is a nozzles plate 61, usually made from a sheet of gold-plated Nickel or of Kapton, of thickness 50 $\mu$m or less, bearing a plurality of nozzles 62, each nozzle 62 being in correspondence with a chamber 64. In the current art, diameter of the nozzles is usually between 10 and 60 $\mu$m, while their centers are usually set apart by a step A of 1/150 or 1/300 of an inch (169 $\mu$m or 84.5 $\mu$m). Usually, though not always, the nozzles 62 are disposed in two parallel rows, staggered by a distance B=A/2, in order to double the resolution of the image in the head scanning direction, which accordingly becomes 1/300 or 1/600 or an inch.

Also in FIG. 1 the axes x, y and z giving the three-dimensional references of the die 51 are defined.

The traditional process for manufacture of the actuator assembly will now be described below in brief, with reference to the flow diagram of FIG. 3, starting from a first step 70 in which a wafer 66 is made available whereupon the dice 51 are made (FIG. 2). In a subsequent step 71, the wafer 66 is tested. In a step 72, the wafer 66 is coated with a layer of photopolymer, generally of the dry film type.

In a step 73 the photopolymer is exposed and, in a subsequent step 74, the chambers 64, in line with the resistors 52, and the ducts 57 are made in the layer of photopolymer 60 (FIG. 1), through development using known techniques.

In a step 75 a protection is applied to the entire wafer and, in a subsequent step 76, the slots 55, which bring the ink to the ducts 57, are cut by way of a sandblasting operation. In a step 77, the protection is washed off and a sight check is made that the component is still whole.

In a subsequent step 100, the nozzles plates 61 are positioned in such a way that the nozzles 62 are aligned with the chambers 64, and stuck on the dice 51 belonging to the wafer 66. Subsequently (step 101 ) the wafer 66 is applied to an adhesive tape 113 (FIG. 4), mounted on a frame 114. The individual dice 51 are separated in a step 102 by cutting with a diamond wheel 115, 50÷100 mm thick (FIG. 5), but are kept fast in their original positions by way of the adhesive tape 113 to which they adhere. Washing and drying are then performed (step 103), using an Ultratech machine for example.

In a step 105, a pick and place device of known technology, picks each die 51 off the adhesive tape 113 and places it with precision (error less than ±10 $\mu$m on the x axis) on an alignment base. In a step 104, in the form of a continuous reel, a multiplicity of flat cables 117 (FIG. 1) is supplied separately, each having a window 122 with fingers 123 that will be soldered to the connecting pads 54 of the dice 51, machine contacts pads 121 and interconnecting tracks 120 which connect the pads 121 to the fingers 123. IN a step 107 the flat cable 117 is aligned with the die 51, with a tolerance of ±5 $\mu$m on the x and y axes. In a step 110 an ultrasound soldering head comes into position above the connecting pads 54 of the die 51, whereto it solders one by one all the fingers 123 of the flat cable 117 (point-to-point TAB). The operations involved in the steps 105, 107 and 110 are effected using the technique known as Tape Automatic TAB).

In a subsequent step 111 the individual flat cables 117 are separated into distinct actuator assemblies 80.

A variant of the known art consists in making the nozzles directly on the flat cable (U.S. Pat. No. 5,278,584), which accordingly also has the function of nozzles plate, and is illustrated in FIG. 6. The flat cable 180 with nozzles is applied on a die 183 in which the feeding of the ink is effected from both sides. As a result, the windows 181 containing the fingers 123 are disposed perpendicularly to the ends of the rows of nozzles.

As the technology evolves, so the demand grows for heads with an ever greater number of nozzles, in order to reduce the number of scanning passes the head needs to complete a page and improve the printer's productivity. To increase the number of nozzles, dice must be produced that are longer and longer and have the minimum possible width (4÷5 mm, where the mechanical requirements permit) so as to better exploit the wafer 66.

Accordingly the slots 55 are particularly long (typically though not exclusively greater than 12.5 mm) and are an open invitation for the dice 51 to break. When the nozzles plates (step 100) are assembled conventionally, the risk of the entire wafer 66 breaking when under pressure during soldering is high, with considerable economic damage.

Even when the step 100 is completed without damage, there is still a high risk of the individual dice 51 breaking in the subsequent machining operations, with serious economic damage on account of the notable dimensions of the dice 51 themselves. With a step A (see FIG. 1) of less than 1/300 of an inch, in practice the nozzles plate have to be produced in kapton. This further increases the risk of the dice 51 breaking.

SUMMARY OF THE INVENTION

The object of this invention is to solve the problem represented by the risk of the dice breaking during the different machining stages of the nozzles assembly of an ink jet printhead, whether monochromatic or colour, by sticking the wafer on a rigid substrate and, instead of cutting the slot in a sandblasting operation, by effecting instead a through cut over the entire length of the dice.

Another object is to handle the individual dice, rendered fragile by the slot, with safety and not expose them to the risks of breaking, keeping them stuck upon a portion of the said base.

A further object is to make resistors underneath said substrate such that the operation of soldering the nozzles plates on the dice may be effected more rapidly, with local heating and a soldering temperature controlled by a sensor.

A further object is to improve the thermal dissipation of said actuator, by using the contribution to heat conduction made by said substrate.

A further object is to lower the time to refill the chamber following emission of the droplet of ink, since the edge of the through cut made with a diamond wheel, is more precise than the edge of the slot made by sandblasting, and can therefore be made at a lesser distance from the resistors.

The above objects are obtained by means of an ink jet printhead with a large-size Silicon wafer and relative manufacturing process, characterized as defined in the main claims.

These and other objects, characteristics and advantages of this invention will be apparent from the description that follows of the preferred embodiment, provided purely by way of an illustrative, non-restrictive example, and with reference to the accompanying drawings, where:

Figure 1:
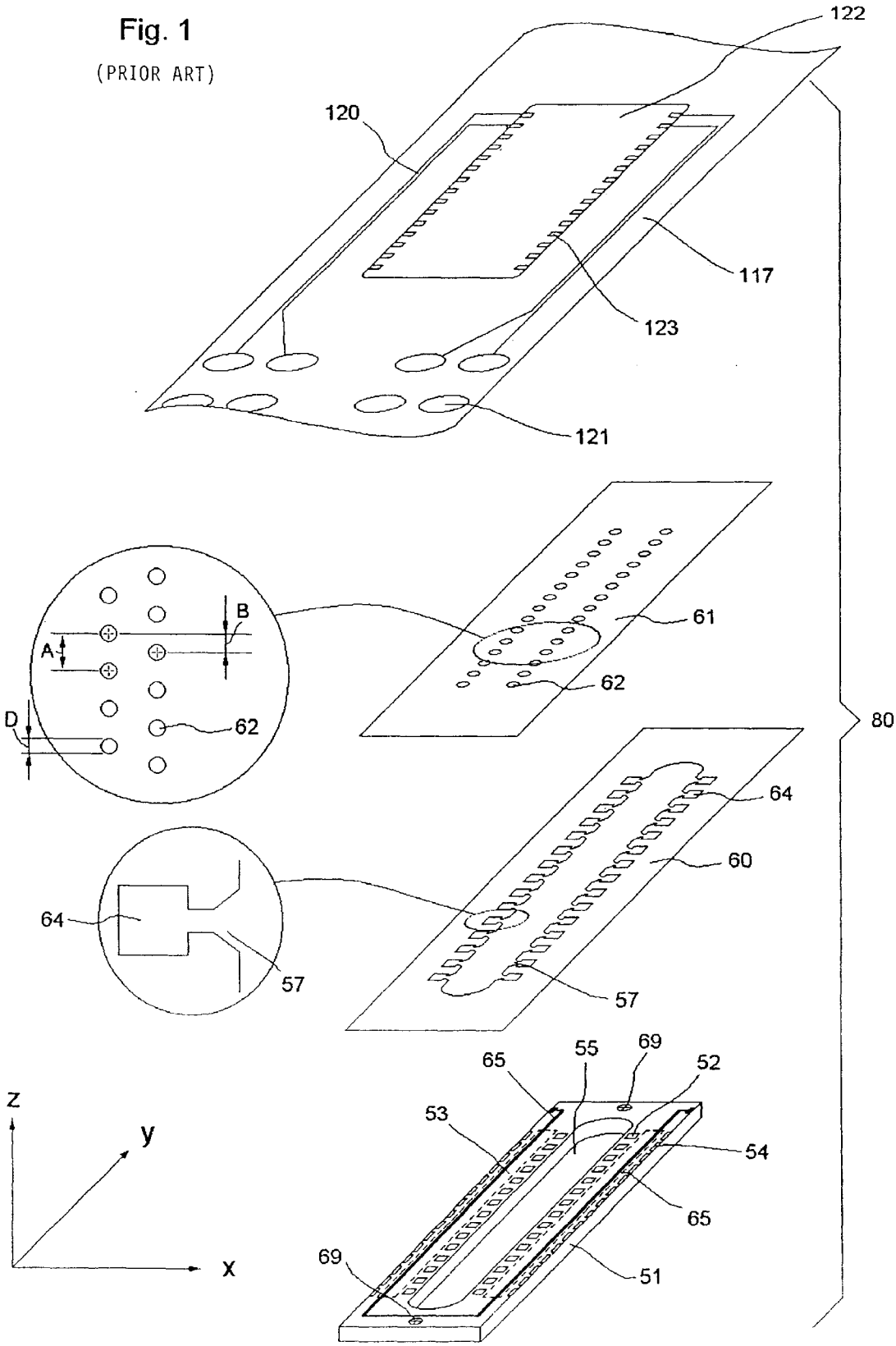
Fig. 1 (PRIOR ART)
FIG. 1 represents an enlarged view of an actuator assembly made according to the known art.
Figure 2:
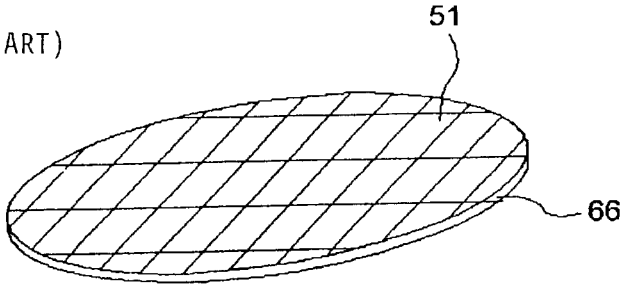
Fig. 2 (PRIOR ART)
FIG. 2 represents a wafer of semiconductor material, containing dice not yet separated.
Figure 4:
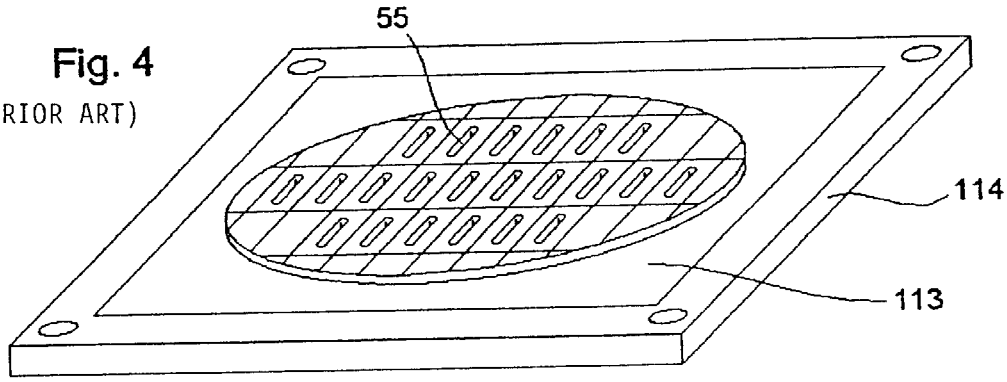
Fig. 4 (PRIOR ART)
Figure 5:
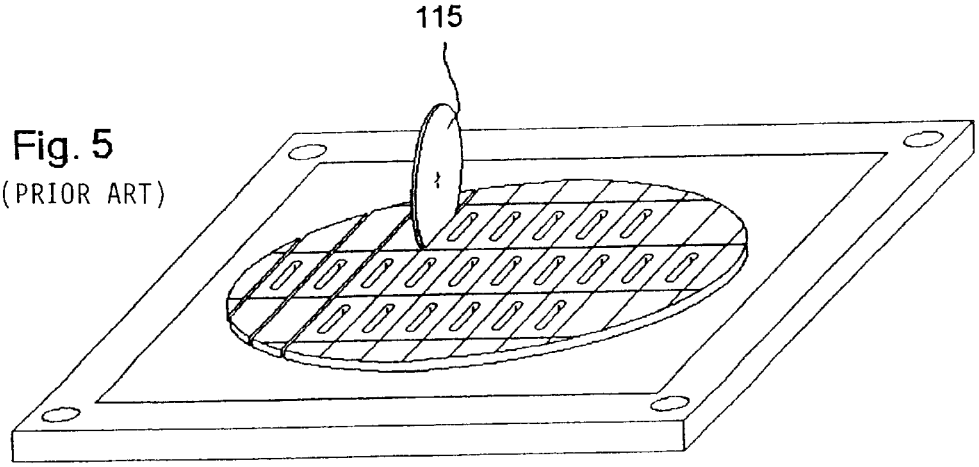
Fig. 5 (PRIOR ART)
Figure 3B:
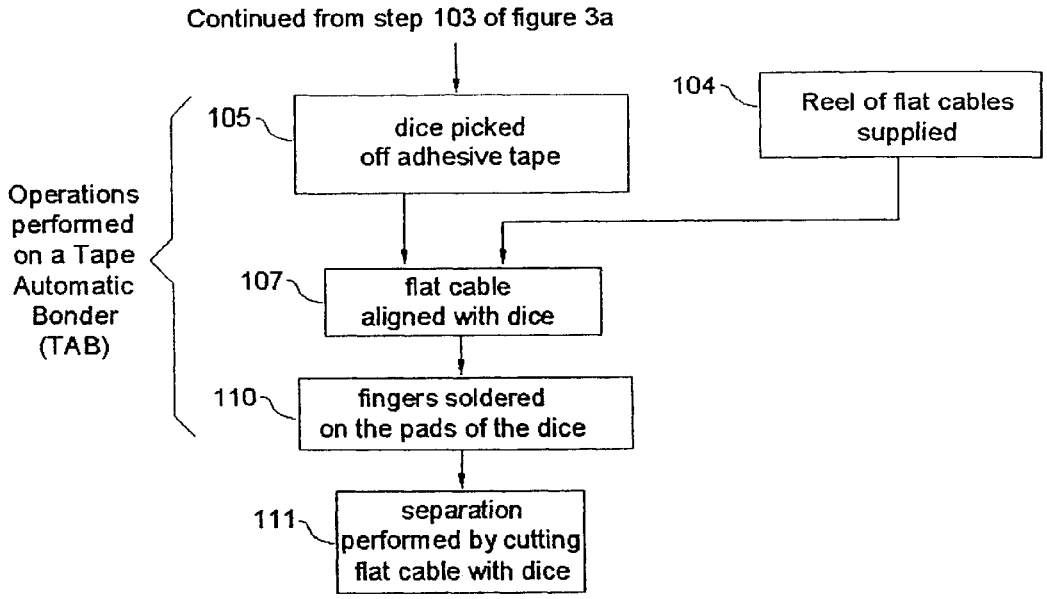
Fig. 3b (PRIOR ART)
Figure 6:
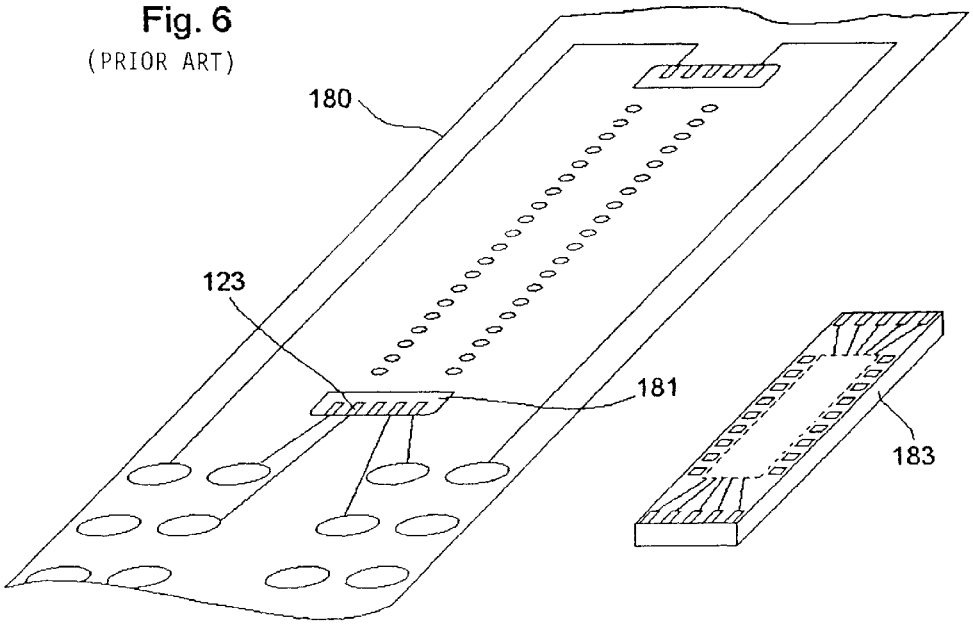
Fig. 6 (PRIOR ART)
Figure 7:
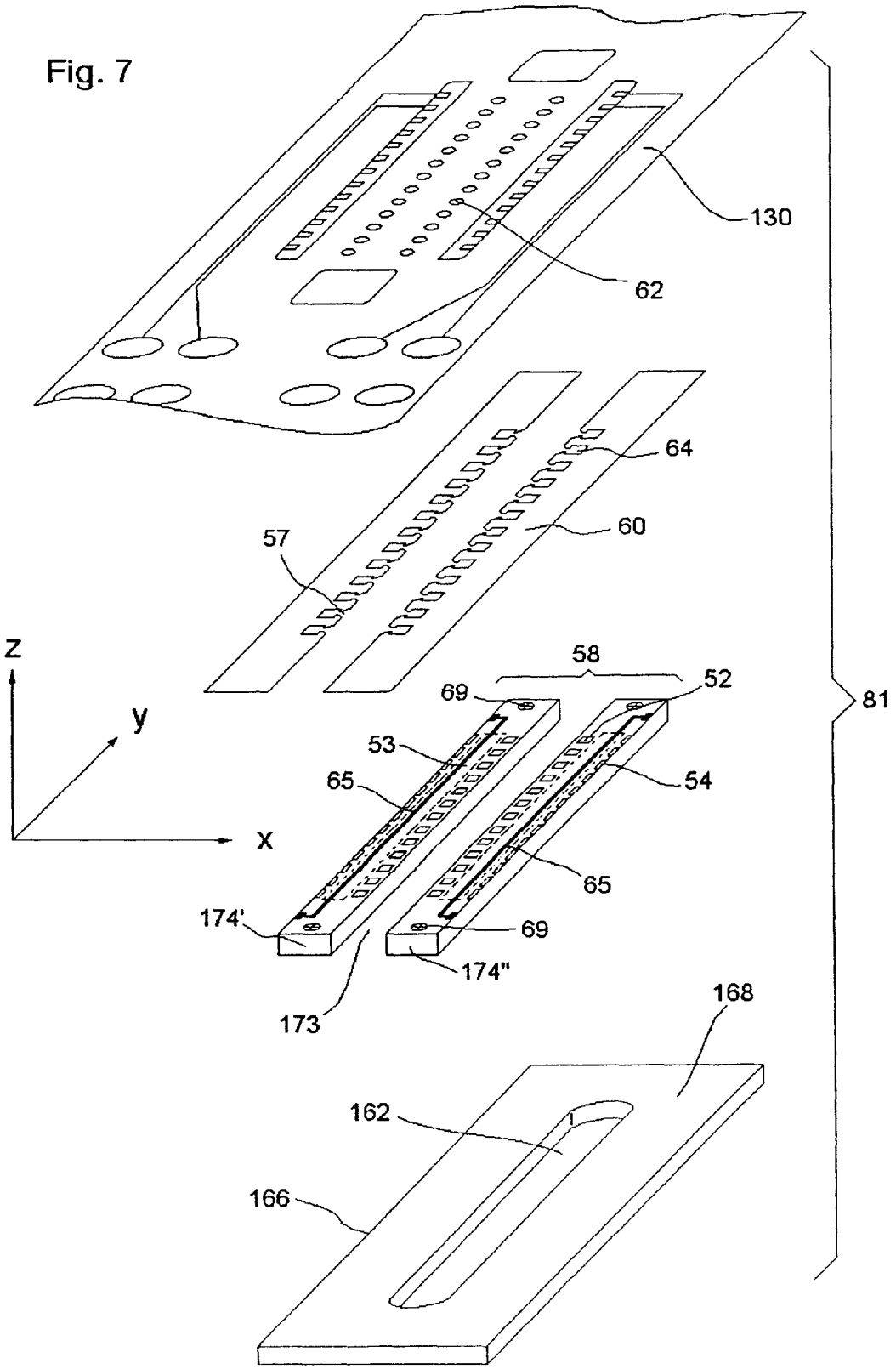
Figure 8:
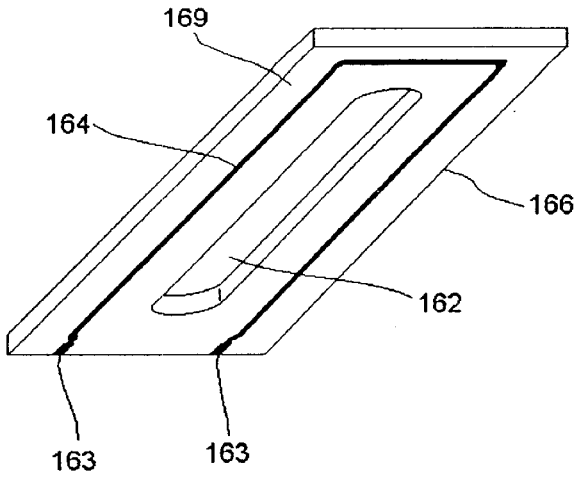
Figure 10:
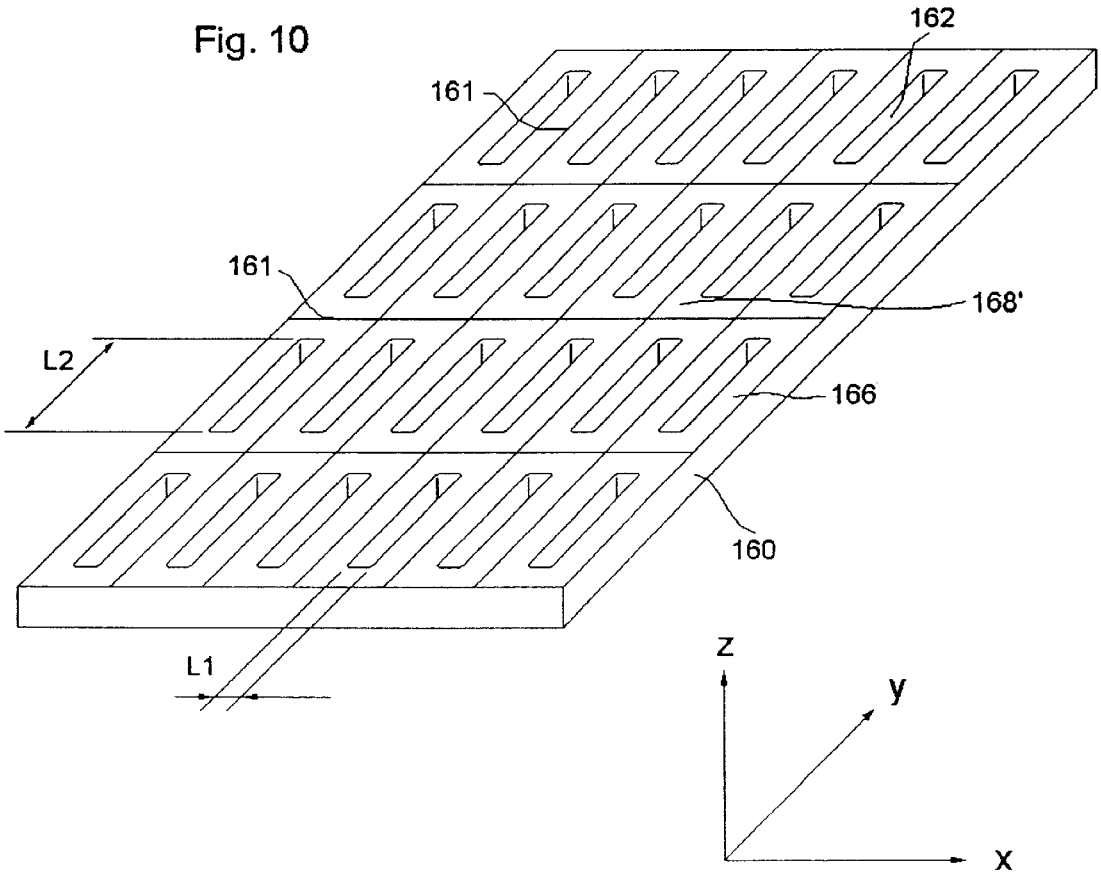
Figures 9, 9A:
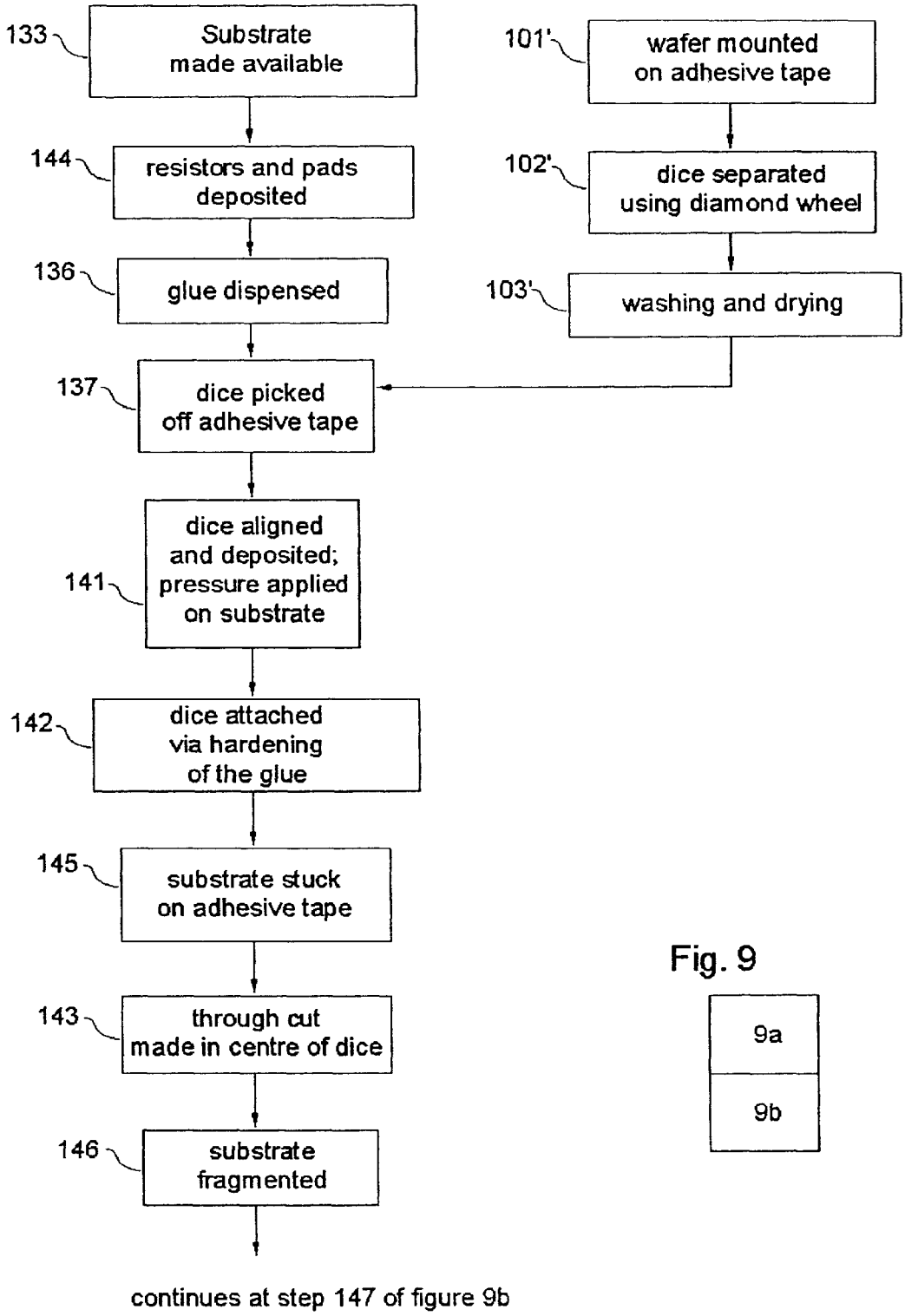
Figure 9B:
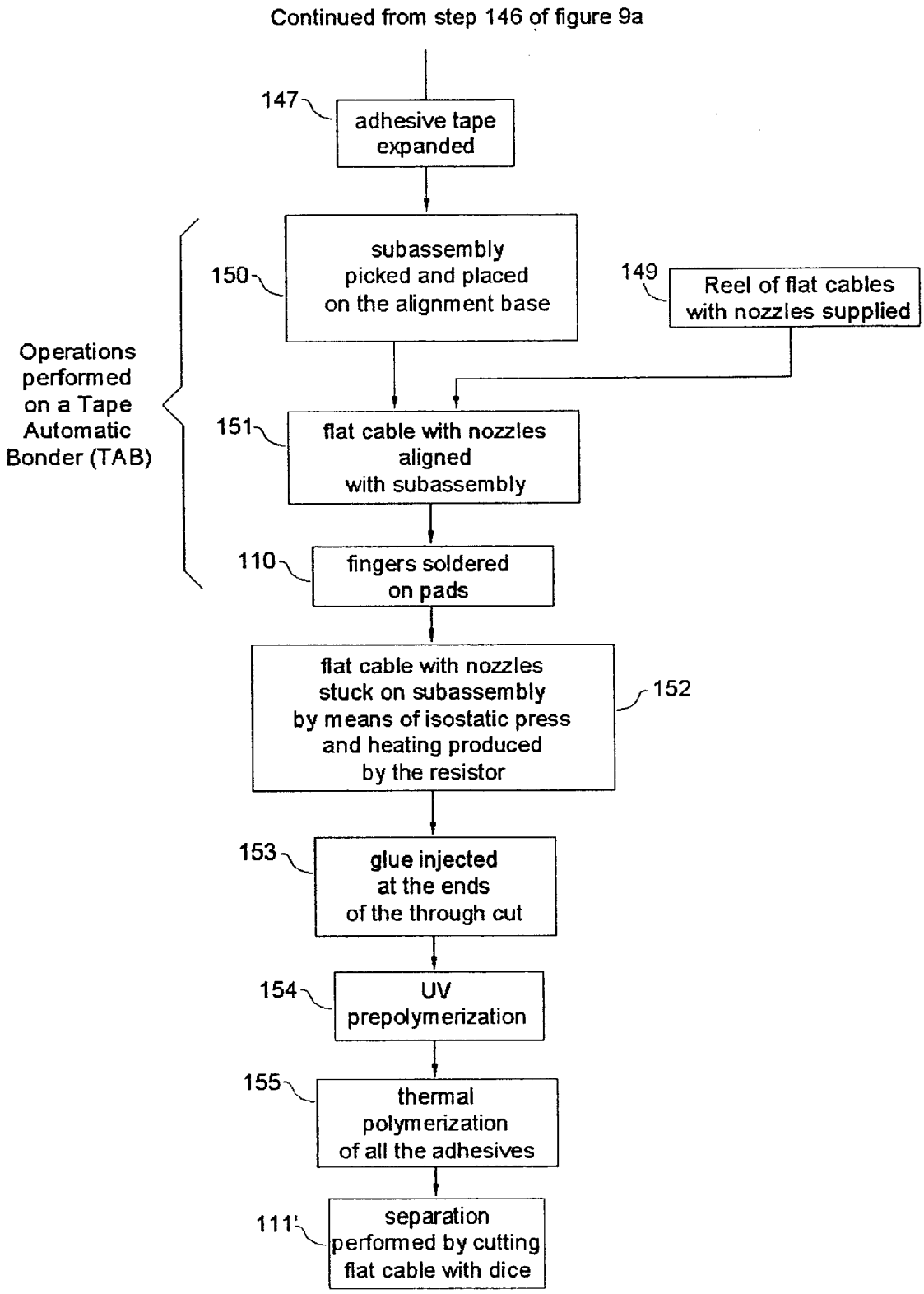
Figure 11:
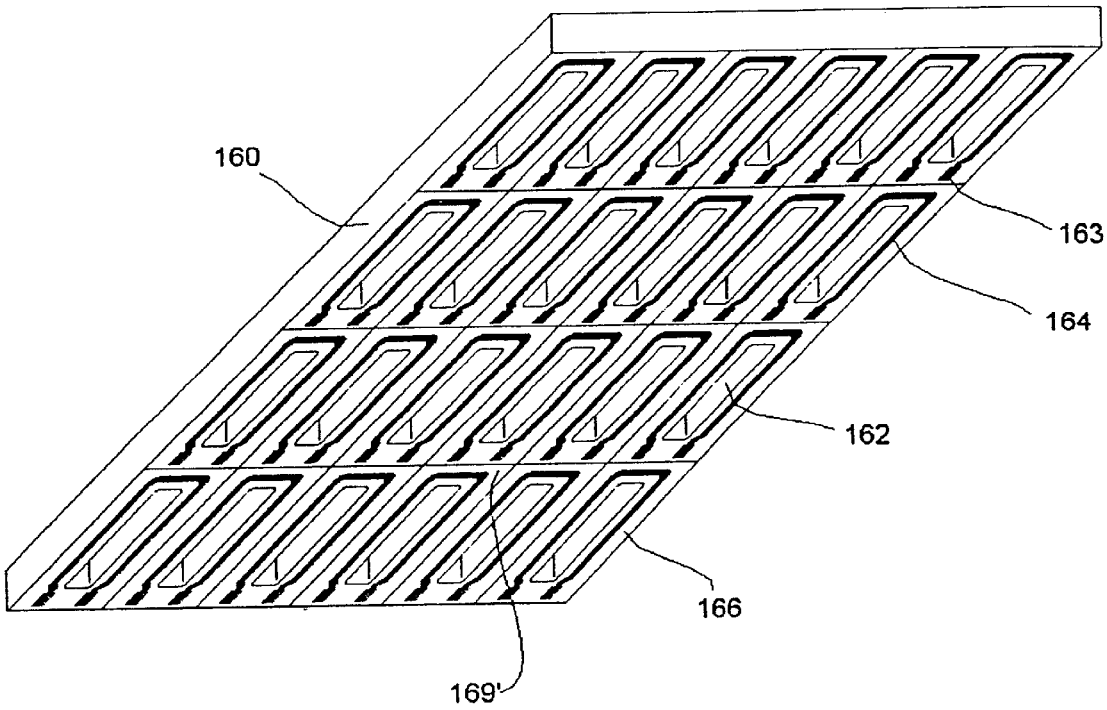
Figure 12:
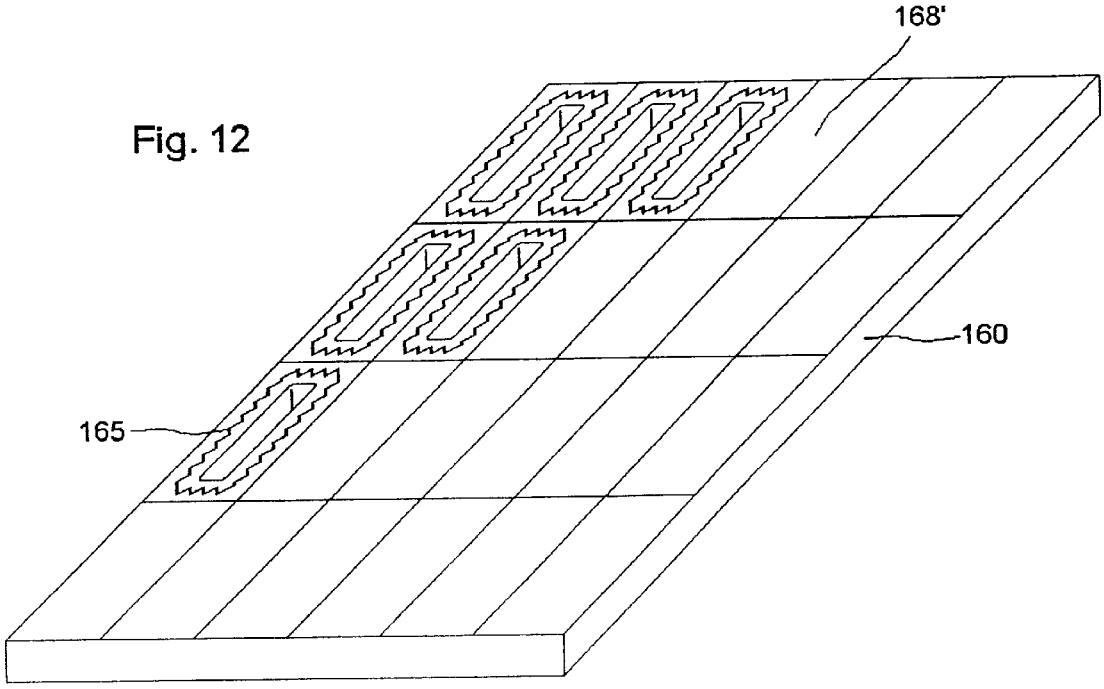
Figure 13:
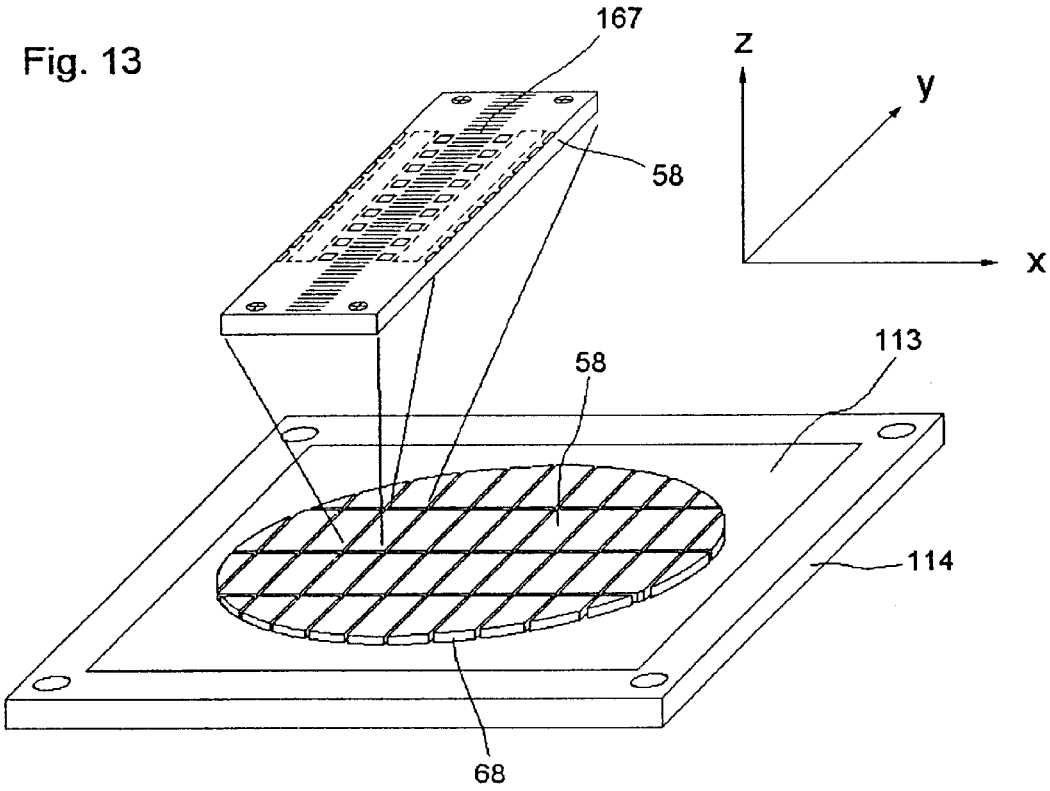
Figure 14:
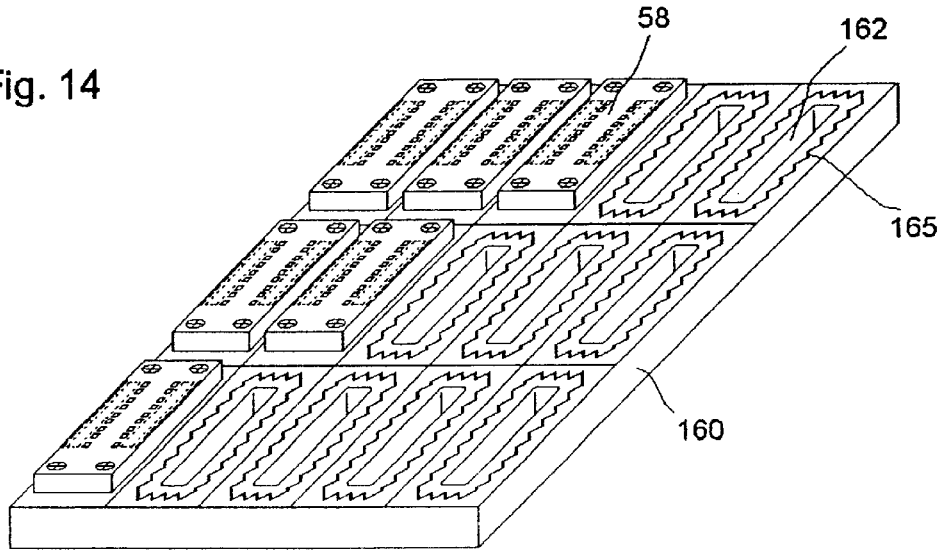
Figure 15:
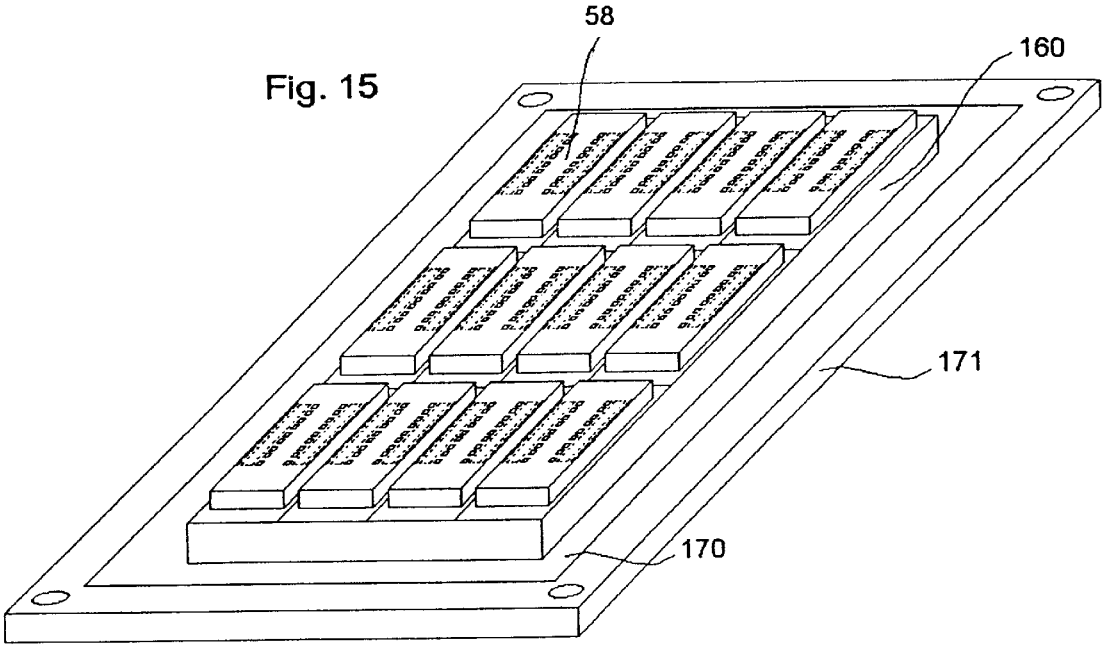
Figure 17A:
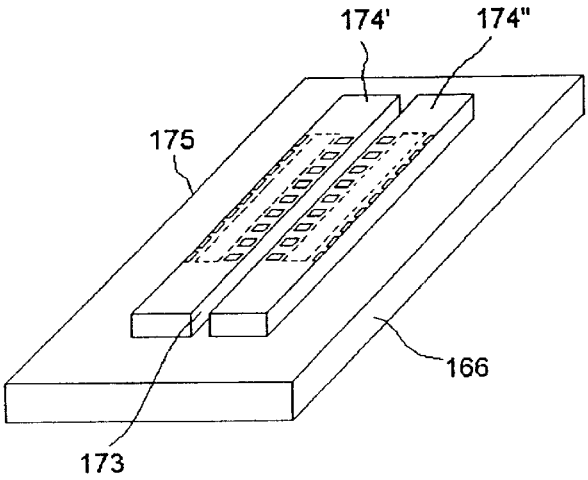
Figure 17B:
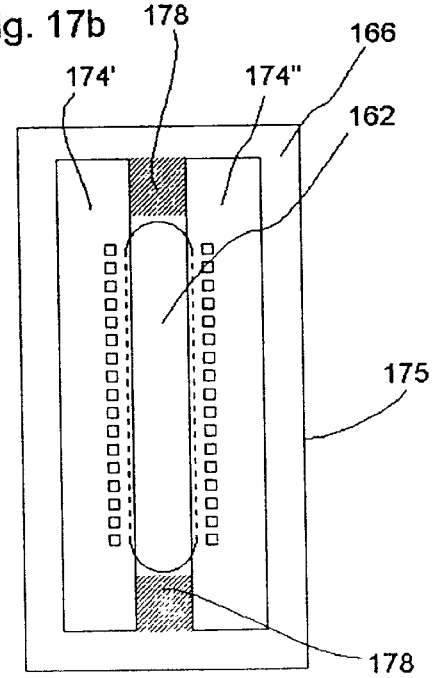
Figure 16:
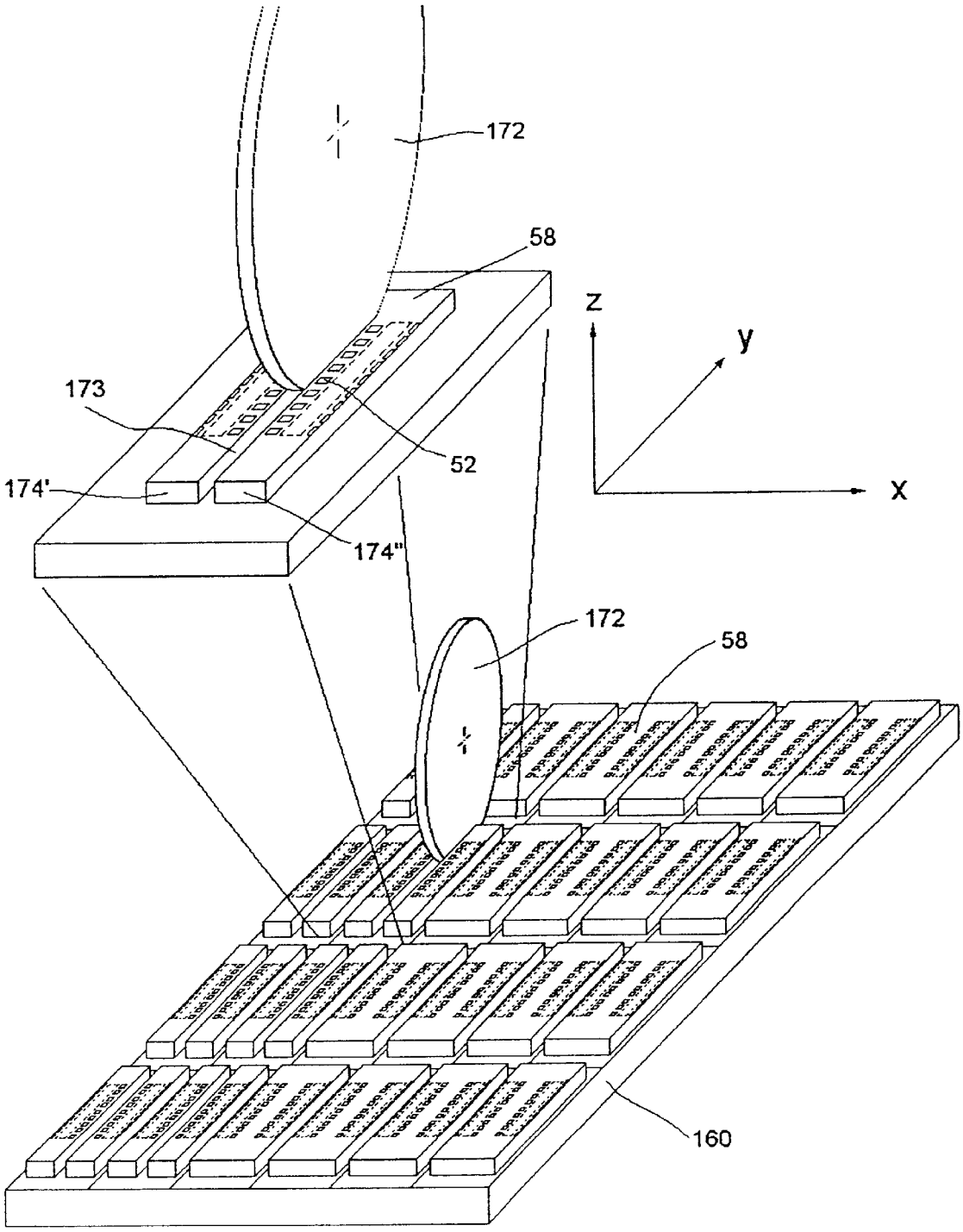
Figure 18:
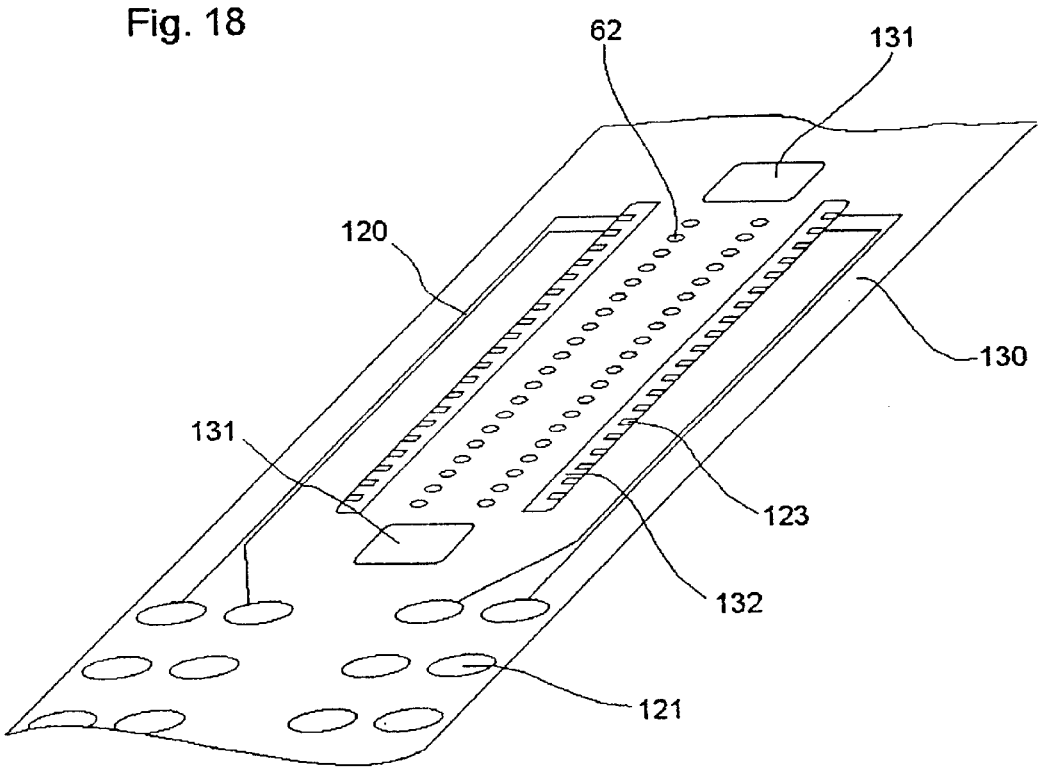
Figure 20:
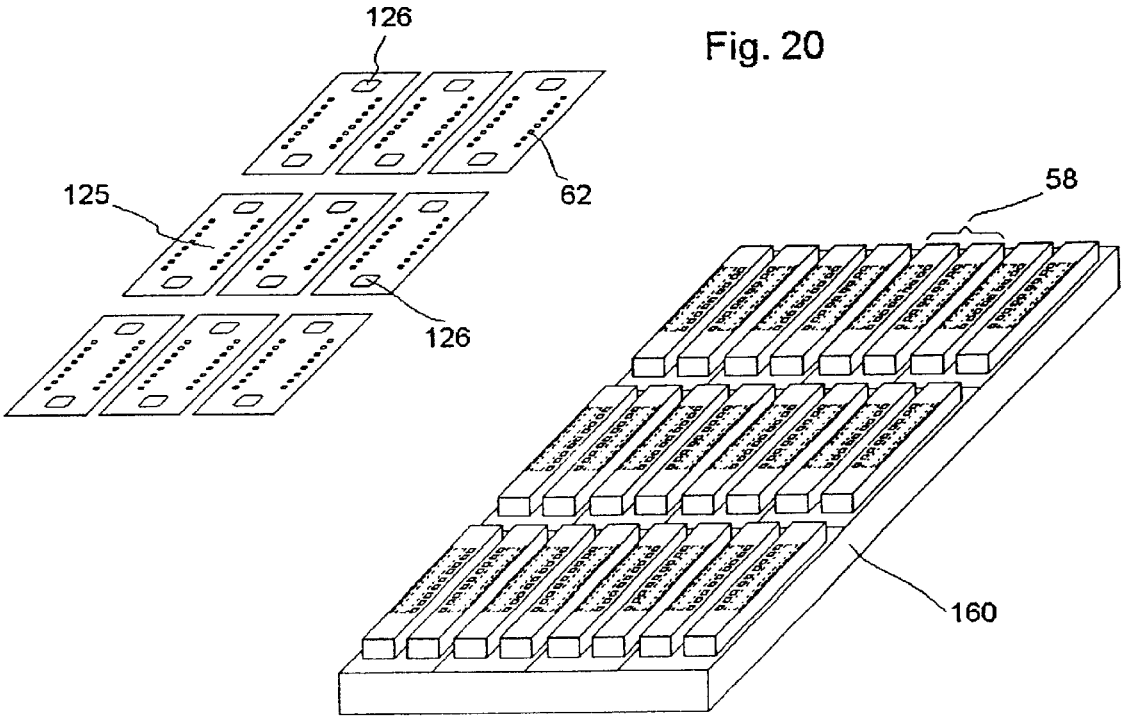
Figure 19:
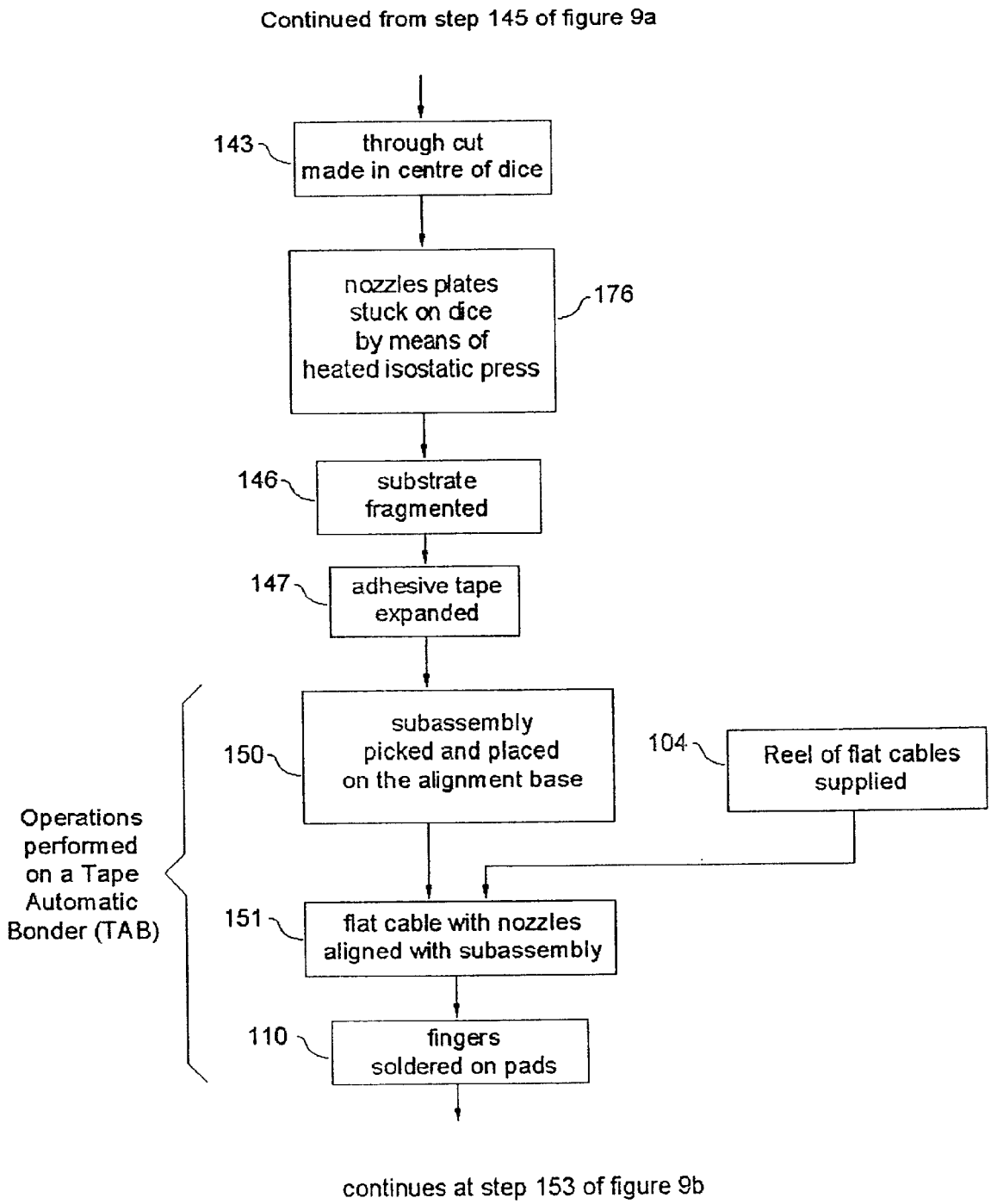
Figure 21:
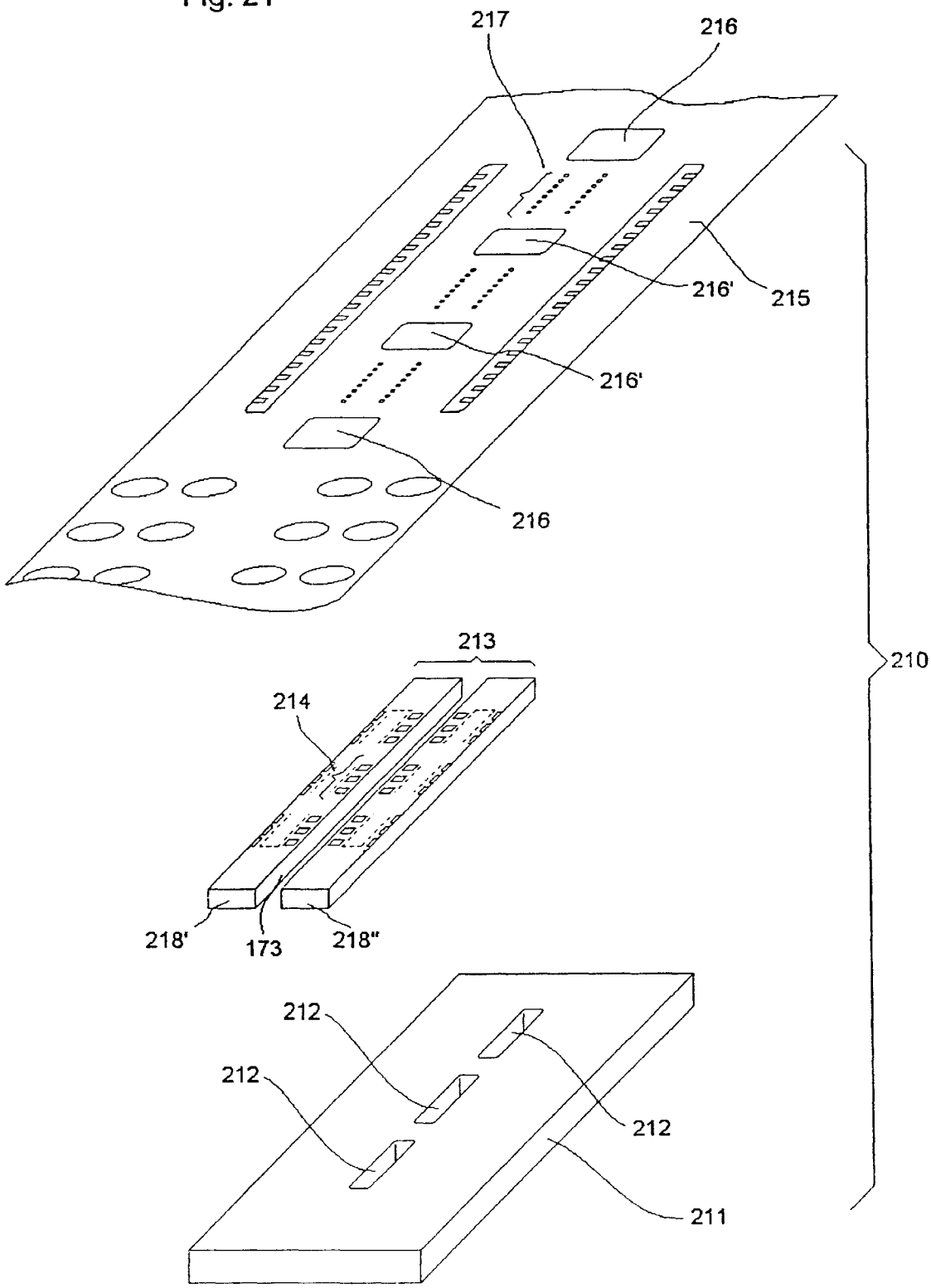

FIG. 3*a* illustrates the flow of the first part of the conventional manufacturing process of the actuator assembly of FIG. 1;

FIG. 3*b* illustrates the flow of the second part of the conventional manufacturing process of the actuator assembly of FIG. 1;

FIG. 4 represents the wafer of FIG. 2 mounted on an adhesive tape;

FIG. 5 represents schematically the operation of separating the dice of FIG. 2 using a diamond wheel;

FIG. 6 represents a known type flat cable provided with nozzles;

FIG. 7 represents an actuator assembly according to the invention;

FIG. 8 represents a resistor screen-printed on one face of a substrate belonging to the actuator assembly of FIG. 7;

FIG. 9*a* illustrates the flow of the first part of the manufacturing process, according to the invention, of the actuator assembly of FIG. 7;

FIG. 9*b* illustrates the flow of the second part of the manufacturing process, according to the invention, of the actuator assembly of 7;, FIG. 10 represents a substrate provided with a pre-incision and slots;

FIG. 11 represents the plurality of resistors screen-printed on the second face of the substrate of FIG. 10;

FIG. 12 represents schematically the operation of spreading the glue on the first face of the substrate of FIG. 10;

FIG. 13 represents a wafer, according to the invention, on which the dice have been separated;

FIG. 14 represents the dice partially mounted on the substrate of FIG. 10;

FIG. 15 represents schematically the operation of sticking the base of FIG. 10 on a adhesive tape;

FIG. 16 represents schematically the operation of making a through cut on the dice with a diamond wheel;

FIG. 17*a* represents a subassembly consisting of the die stuck on a support wafer produced by fragmenting the substrate of FIG. 10;

FIG. 17*b* is the plan view of the same subassembly of FIG. 17*a*, illustrating the areas destined to receive the glue that will seal the ends of the through cut;

FIG. 18 represents a flat cable with nozzles according to the invention;

FIG. 19 illustrates the flow of the manufacturing process of the actuator assembly of FIG. 7*a*, in accordance with a second embodiment;

FIG. 20 represents nozzles plates, in accordance with the second embodiment, that are stuck on the dice; and FIG. 21 represents an actuator assembly of a colour printhead, according to the invention.

DESCRIPTION OF THE PREFERRED EMBODIMENT

FIG. 7 represents the enlarged view of an actuator assembly 81 of a monochromatic ink jet printhead, according to this invention. Being already known and not directly concerning the invention, the other parts of the head have been omitted for simplicity's sake. In particular, the actuator assembly 81 comprises:

a support plate 166;

a die 58;

a layer of photopolymer 60';

a flat cable with nozzles 130.

The support plate 166, of a thickness preferably between 0.6 and 1 mm, is made preferably though not exclusively of ceramic; it contains a pass-through slot 162, and a first face 168.

The die 58 is divided into two semidice 174' and 174", specularly substantially identical, between which there is a through cut 173 replacing the slot 55. The die 58, like the die 51 of FIG. 1, contains the resistors 52, the driving circuits 53, the pads 54, and the resistive temperature sensor 65.

The layer 60' of photopolymer is also divided into two parts, and is laid over the die 58. Like the layer of photopolymer 60 in FIG. 1, it contains a plurality of ducts 57 and a plurality of chambers 64 located in correspondence with the resistors 52.

The flat cable with nozzles 130, usually though not exclusively, consists of a kapton plate of thickness less than or equal to 50 $\mu$m, bears the plurality of nozzles 62, and is stuck on top of the photopolymer 60'.

Also defined in FIG. 7 are the x, y and z axes representing the three-dimensional references of the die 58.

Visible in FIG. 8 is a second face 169 of the plate 166, upon which a resistor 164 of Rutenium Oxide or similar, placed all around the slot 162, and two pads 163 of Ag Pd or similar, connected to the ends of the resistor 164, have been deposited, for example by screen printing or by evaporation in a vacuum.

FIG. 9*a* illustrates the first part of the flow diagram of the process used for manufacturing the head of the invention according to one embodiment thereof.

Steps 101', 101', 103' are effected, similar to the steps 101, 102, 103 of the known process. In the step 101' a wafer 68, containing the dice 58, is applied to the adhesive tape 113.

The individual dice 58 are separated in the step 102' by means of the cut made with the diamond wheel 115, and are kept fast in their original positions by means of the adhesive tape 113 to which they adhere. Washing and drying are then effected in the step 103'.

FIG. 13 represents a wafer 68, upon which the dice 58 are made, stuck to the adhesive tape 113 borne by the frame 114. Depicted in the enlargement is the single die 58, before it is divided into the two semidice 174' and 174", where the area 167 that must be left completely free of components, tracks, resistors, ducts, etc. is illustrated in dash lines.

In parallel (step 133 of FIG. 9*a*), and using known technologies, a substrate 160 (FIG. 10) is made available, preferably though not exclusively made of ceramic, between 0.6 and 1 mm thick and having a first face 168' bearing an incision of an orthogonal grating, referred to in the following as pre-incision 161, having steps in the x and y directions preferably 0.2÷0.5 mm greater than the corresponding steps of the dice 58 on the wafer 68.

The base 160 also has a plurality of slots 162, made using known techniques, each slot 162 being substantially in the centre of each corresponding rectangle 166 delimited by the pre-incision 161. Each slot 162 has a substantially rectangular shape, with a first dimension L1 approximately 0.2 mm greater than the width of a cut in the silicon die that will be illustrated in more detail later, and a second dimension L2 obtained from the following expression:

$$L2=A\cdot(N-1)+B+D+C$$

where, with reference to FIG. 1, A represents the step between the nozzles, N the number of nozzles in a row, B the stagger between the rows, D the diameter of a nozzle, and where the term C, of a value preferably between 0.2 and 0.5 mm, is added to guarantee a greater flow of the ink to the nozzles located at the ends of the rows.

In a subsequent step 144, on a second face 169' of the substrate 160 (FIG. 11), the plurality of pads 163 and the plurality of resistors 164 are screen-printed around each slot 162.

In the step 136, a continuous bead 165 of epoxy glue (FIG. 12) is dispensed on the first face 168' of the base 160 by means of known technologies, such as for example screen-printing, use of a needle actuated off-line, use of a preform syringe with screen-extruded glue, stopping-out. The bead 165 must be continuous to prevent ink from seeping out during operating, and must be distributed with constant thickness in order to create uniform mechanical support and heat conduction between the die 58 and the base 160.

In the step 137, using a known type automatic pick-and-place machine, a die 58 is picked off the adhesive tape 113.

In the step 141 the pick-up moves above the base 160, aligns itself and deposits the die 58; the die 58 is then pressed against the bead of glue 165. The first die 58 picked and placed on the base 16*o* is aligned with the slot 162 with a tolerance of ±50 $\mu$m on the x and y axes 162, and is taken as the reference. The reference marks 69 of the dice 58 deposited subsequently are aligned with the marks 69 of the first die 58 with a tolerance of ±10 mm on the x axis.

Shown in FIG. 14 is the base 160 on which part of the dice 58 have been stuck. In a step 142, attachment of the die 58 is effected to the base 160 by hardening of the bead of glue 165, using known technologies.

In a subsequent step 145 the base 160 is stuck on an adhesive tape 170 (FIG. 15) borne by a frame 171. In the step 143 the through cuts 173 (FIG. 16) are made on the dice 58 with a diamond wheel 172 of a thickness preferably between 100 and 300 mm, which effects a single cut of the whole column of dice 58 in the y axis direction, at a low feed rate. The precision alignment along the x axis, effected in the step 141, ensures that the cuts 173 of all the dice 58 of a column are made at the right distance from the resistors 52. The semidice 174' and 174" remain aligned because they are stuck to the support 160. In a subsequent step 146 the base 160 is broken along the incisions of the pre-incision 161, and the individual subassemblies 175 are obtained (FIG. 17*a*), consisting of the individual support plates 166 to which the semidice 174' and 174", separated by the through cut 173, are stuck. In the plan view of the subassembly 175 (FIG. 17*b*), the areas 178 destined to receive the glue for end sealing of the through cut 173 are illustrated in dash lines.

The subsequent operations will now be described with reference to FIG. 9*b*. In the step 147 the adhesive tape 170 is expanded, after which the subassemblies 175 are still adhering to the adhesive tape 170, but are at a distance of 0.2÷0.5 mm from each other.

In a step 149, a multiplicity of flat cables with nozzles 130 in the form of a continuous reel is supplied separately (FIG. 18). The flat cable 130 has nozzles 62, and in this way also performs the function of nozzles plate. It also has the fingers 123 accommodated inside appropriate windows 132, and slots 131 destined to accommodate the glue that will seal the ends of the through cut 173. For usage of the flat cable 130 integrating the function of nozzles plate, a technique for attachment to the subassembly 175 is required that will be described in the steps that follow.

On the TAB machine, the subassembly 175 is picked off the adhesive tape 113 and placed on an alignment base (step 150); the flat cable with nozzles 130 is aligned with the subassembly 175 (step 151) and the fingers 123 are soldered on the pads of the die 154 (step 110). In a subsequent step 152, the flat cable 130 is stuck on the subassembly 175. This is done by applying pressure on the flat cable using an isostatic press of known technology, while at the same time the subassembly 175 is heated using the resistor 164 located on the face 169 of the support plate 166, while the temperature of the soldering cycle is detected by means of the sensor 65 already present on the die 58 for effecting the known function of temperature control during operation of the head. This enables the sticking operation to be performed much faster and under better controlled temperature conditions, as the heating is dosed using the sensor 65 for feedback, at no extra cost.

In a subsequent step 111' the individual flat cables 130 are separated into distinct actuator assemblies 81.

A first variant of the preferred embodiment consists of the fact that the pads 163 and the resistors 164 are made before the slots 162 are drilled. In the step 133 a substrate still minus the slots is made available. The step 144 follows, in which the pads 163 and the resistors 164 are made. Next the slot holes 162 are drilled by way of a $CO_2$ laser cut and the pre-incision 161 is made.

In a second variant of the preferred embodiment, after the dice 58 have been stuck on the base 160, the through cut 173 is not made, but instead the slots 55 are drilled by sand-blasting through the slots 162 already made in the base 160. With this system, each slot 55 can be made very close to the end edges of the die 58 without any danger of breaking as the flow of sand is guided by the slot 162 in the base 160. This allows a better feeding of ink to the end nozzles during operation.

A third variant of the preferred embodiment consists of the fact that the entire wafer 68 is stuck on the base 160 for reference, while the separation of the dice 58 along the y axis made with the grinding wheel 115 and the through cut 173 made with the grinding wheel 172 are effected subsequently in a single machining operation.

$2^{nd}$ embodiment—This embodiment of the actuator of the printhead according to the invention differs from the preferred embodiment in that the flat cable with nozzles 130 is replaced by the nozzles plate 125, which comprises the nozzles 62 and two slots 126 (see FIG. 20), and by the flat cable 117 (see FIG. 1). In addition, the resistor 164 and the pads 163 are not made on the face 169 of the support plate 166. This embodiment follows the steps of the preferred embodiment, with the exception of step 144, through to the step 143 (FIG. 9*a*), in which the through cut 173 is made in the centre of the dice 58. Then the nozzles plates 125 are stuck on the dice 58 by means of the heated isostatic press of known technology (step 176, FIG. 19). Following this, the substrate 160 (step 146) is fragmented, and the adhesive tape 170 expanded (step 147). In the step 104, the reel of flat cable 117, including the window 122, is supplied. The steps 150, 151 and 110, already described in the preferred embodiment, are effected on the TAB line. The method continues with the steps 153 and following, as described in the preferred embodiment (FIG. 9*b*). In a first variant of this embodiment, the entire wafer 68 is stuck on the base 160, while the separation of the dice 58 along the y axis made with the grinding wheel 115 and the through cut 173 made with the grinding wheel 172 are effected subsequently in a single machining operation.

Naturally, the principles of this invention are also applicable to the manufacture of a colour head, using three or more monochromatic inks to compose a wide range of perceptible colours. To describe the production of the colour head, reference is made, though not exclusively, to the preferred embodiment of the monochromatic head. The actuator assembly 210 of a colour head comprises the following parts (FIG. 21):

- a wafer 211, in which three distinct slots 212 are made;
- a die 213, divided into two semidice 218' and 218", in each of which three groups of resistors 214 are made;
- a flat cable 215, bearing three groups of nozzles 217, two end slots 216 into which the glue that will seal the ends of the through cut 173 is introduced and two intermediate slots 216' into which the glue that separates the different colour inks is introduced.

The colour head manufacturing process corresponds to the one described in the preferred embodiment and illustrated with the flow diagram of FIGS. 9*a* and 9*b*, where the support plate 166, the die 58 and the flat cable with nozzles 130, i.e. those of the monochromatic head, are replaced by the support plate 211, the die 213 and the flat cable 215. In the step 153, the end slots 216 and the colour separation slots 216' are sealed with glue.

In general, if M is the number of different inks used by the head, the number of intermediate slots 216' will be M-1.

If two inks are used (for example, graphic black and character black), a single intermediate slot 216' is needed;

- if four inks are used (for example, yellow, magenta, cyan and character black), three intermediate slots 216' are needed;
- if five inks are used (for example, yellow, magenta, cyan, graphic black and character black), four intermediate slots 216' are needed;
- if six inks are used (for example, three full colours and three light colours), five intermediate slots 216' are needed;

Here again, the actuator assembly of the colour head can be made according to variants and embodiments similar to those described previously for the actuator assembly of the monochromatic head.

In short, while fully maintaining the principle of this invention, the construction details and the embodiments may be abundantly varied with respect to what has been described and illustrated, without departing from the scope of the invention.

What is claimed is:

1. Process for manufacturing a thermal ink jet printhead, comprising the steps of:

disposing of a substrate provided with a slot and having a first face and a second face opposite said first face; and disposing of a die of semiconductor material containing means for generating the emission of droplets of ink, wherein it further comprises the steps of:

disposing of a temperature sensor assembled on said die of semiconductor material, said temperature sensor being provided for detecting the temperature of said emission means during operation of said printhead;

disposing of a flat cable comprising a plurality of nozzles through which said droplets of ink are emitted;

depositing, on said second face of said substrate, all around said slot a strip shaped resistor provided;

attaching said die to said first face of said substrate;

dividing said die into two substantially symmetrical parts by means of a through cut in correspondence with said slot in said substrate;

sticking said flat cable on said die by means of heating produced by said resistor;

and detecting by means of said temperature sensor, the temperature of the sticking zone in order to dose the heating produced by said resistor.

2. Thermal ink jet printhead for the emission of droplets of ink on a print medium, comprising:

a die of semiconductor material containing emission means for generating said emission of said droplets of ink, said die having a substantially rectangular shape, with a greater side and a lesser side, a tank containing ink, a flat cable soldered on said die and comprising a plurality of nozzles through which said droplets of ink are emitted and means for connecting said die with an electronic controller, and a substrate provided with a slot, said die being attached to a first face of said substrate, and being further divided into two substantially symmetrical parts by a through cut, parallel to said greater side, said slot being located in correspondence with said through cut, and said tank being in fluid communication with said slot and with said through cut, wherein said printhead further comprises a resistor deposited on a second face of said substrate opposite said first face to which said die is attached, said resistor being placed all around said slot and being provided for heating the die and the flat cable in the zone in which they are soldered together, and a temperature sensor placed on said die and parallely arranged to said emission means for detecting the temperature of said emission means during operation of the printhead, said temperature sensor being also provided for detecting the temperature of the soldering between said flat cable and said die in order to control the heating generated by said resistor.

* * * * *